US006739017B1

(12) United States Patent
Johnson

(10) Patent No.: US 6,739,017 B1
(45) Date of Patent: May 25, 2004

(54) COMBINATION PAINT ROLLER AND SHIELD

(76) Inventor: Earl Johnson, 352 Midwood St., Brooklyn, NY (US) 11225

( * ) Notice: Subject to any disclaimer, the term of this patent is extended or adjusted under 35 U.S.C. 154(b) by 176 days.

(21) Appl. No.: 10/174,556

(22) Filed: Jun. 19, 2002

(51) Int. Cl.[7] ..... B05C 17/02
(52) U.S. Cl. ..... 15/248.2; 15/230.11
(58) Field of Search ..... 15/230.11, 246, 15/248.1, 248.2

(56) References Cited

U.S. PATENT DOCUMENTS 2,160,570 A * 5/1939 Weit ..... 15/230.11
2,807,041 A * 9/1957 Watro ..... 15/248.1
2,835,915 A * 5/1958 Pearson ..... 15/248.2
3,029,458 A * 4/1962 Balicki ..... 15/230.11
3,058,145 A * 10/1962 Hegedus ..... 401/208
3,538,532 A * 11/1970 Shortino et al. ..... 15/230.11
4,011,622 A * 3/1977 Gillum et al. ..... 15/248.2
4,254,529 A * 3/1981 Cooke ..... 15/230.11
4,569,099 A * 2/1986 Harding ..... 15/248.2
4,821,362 A * 4/1989 Kolb ..... 15/248.2
5,400,459 A * 3/1995 Jarecke et al. ..... 15/230.11
5,960,511 A * 10/1999 Boyce ..... 15/248.2

* cited by examiner

*Primary Examiner*—Mark Spisich
(74) *Attorney, Agent, or Firm*—Robert J. Bird

(57) ABSTRACT

A shield for a paint roller of the type having a roller support member with a roller on one end and a handle on the other end, includes a bottom, sidewalls, backwall, and a handle extending rearward, all in a dust pan configuration. The handle is a cylinder forming a tunnel therealong, and includes a hinge along one side on which to open and close the handle, and a clasp on the opposite side to secure the handle in a closed condition. The shield handle opens and closes to grasp the roller handle, and to permit axial adjustment of the roller handle relative to the shield handle.

2 Claims, 1 Drawing Sheet

COMBINATION PAINT ROLLER AND SHIELD

BACKGROUND OF THE INVENTION

This invention is a combination paint roller and shield.

Various paint roller and spatter shield combinations are known to the prior art.

The following patents are the prior art that I know of:

U.S. Pat. No. 4,011,622—Grum et al;

U.S. Pat. No. 4,254,529—Cooke;

U.S. Pat. No. 4,821,362—Kolb;

U.S. Pat. No. 5,400,459—Jarecke et al;

U.S. Pat. No. 5,960,511—Boyce

The above patents show various paint rollers, each partially surrounded by a generally semi-cylindrical shield which moves along with the roller to shield the user and the surroundings from paint spatter.

SUMMARY OF THE INVENTION

In summary, this invention is a shield for a paint roller of the type having a roller support member with a roller on one end and a handle on the other end. The shield includes a bottom, sidewalls, backwall, and a handle extending rearward, all in a dust pan configuration. The handle is a cylinder forming a tunnel therealong, and includes a hinge along one side on which to open and close the handle, and a clasp on the opposite side to secure the handle in a closed condition. The shield handle opens and closes to grasp the roller handle, and to permit axial adjustment of the roller handle relative to the shield handle.

DETAILED DESCRIPTION

Figure 2:
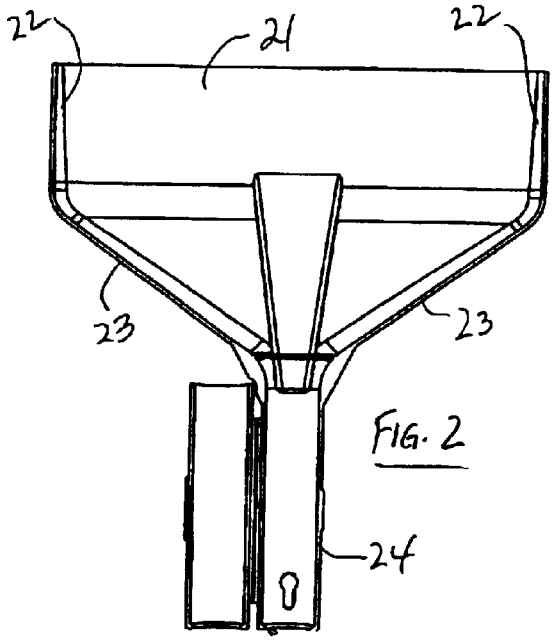
FIG. 2 is a plan view, as from the lower left of FIG. 1, without the paint roller.

The drawing shows several views of a standard paint roller combined with a paint shield according to this invention.

The paint roller 10 includes a cylindrical roller member 11 rotatably connected to a roller support 12. The roller support 12 includes a shaft portion 13 on which the roller member 11 is rotatably mounted, and a roller handle 14. The roller support 12 extends radially from the roller, and is so configured that the roller handle 14 is normal to the middle of the roller member 11.

The paint shield 20 includes a bottom 21, sidewalls 22, back wall 23, and an elongated shield handle 24 extending rearward of the back wall 23 in a direction parallel to the sidewalls 22. The shield handle 24 is a hollow cylinder, forming a tunnel along its length. The handle 24 includes a lengthwise hinge 26 along one side by which to open and close the handle, and a clasp 27 on the opposite side by which to secure the handle in its closed position. The shield handle 24 opens for placement within it (and removal from it) of the roller handle 14. The shield handle 24 fits snugly around the roller handle 14 to keep the roller handle from slipping or turning relative to the shield handle 24 during use.

Figure 1:
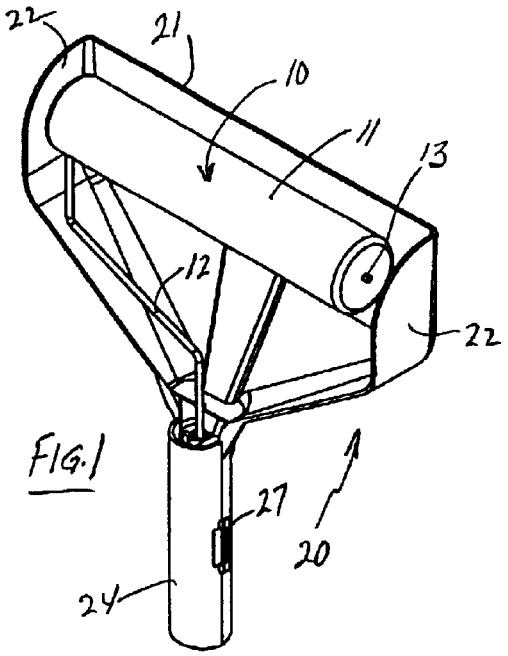
FIG. 1 is a perspective view of the paint roller and shield of this invention.
Figure 3:
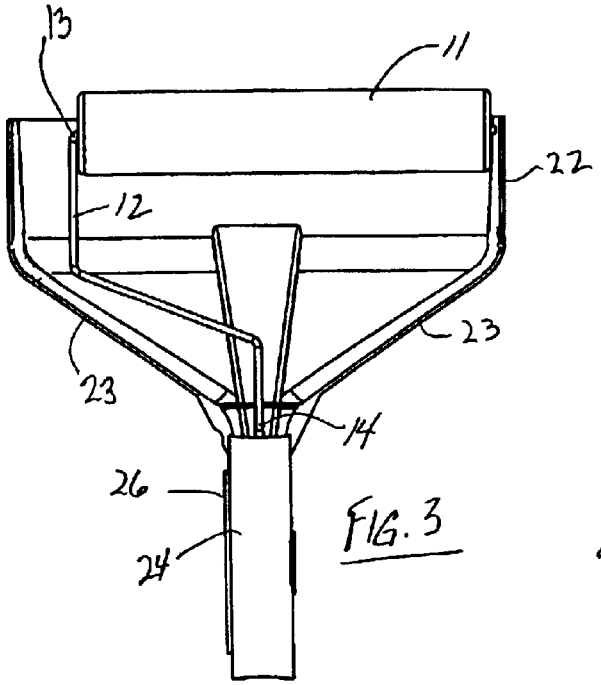
FIG. 3 is a plan view, similar to FIG. 2, with a paint roller in place.
Figure 4:
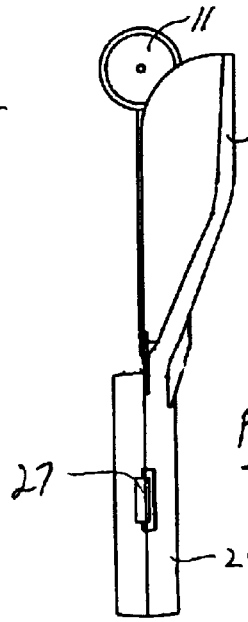
FIG. 4 is a right side view of FIG. 3.

This combination paint roller and shield allows the user to paint without spatter. The snug fit of the shield handle 24 within the roller handle 14 permits adjustment of the axial position of the roller handle 24 relative to the shield handle 14. The significance of this is that the roller 10 can be extended somewhat forward of the shield 20, if desired, to get the shield "out of the way". This is important for certain work, for example where space is a factor. Forward and rearward adjustability of the roller 10 relative to the shield 20 is shown in FIGS. 3 and 4 vis-a-vis FIG. 1. The roller 10 and shield 20 are easily separated for cleaning, simply by opening the shield handle 24.

The paint shield 20 is configured generally similar to a dust pan, so that it serves also as a "roller rest", permitting the unit to be set down in situ, independent of a paint pan.

Any terms indicative of orientation are used with reference to drawing illustrations. Such terms are not intended as limitations but as descriptive words. Apparatus described herein retains its described character whether it be oriented as shown or otherwise.

The foregoing description of a preferred embodiment of this invention sets forth the best mode presently contemplated by the inventor of carrying out this invention. Any details as to materials, quantities, dimensions, and the like are intended as illustrative. The concept and scope of the invention are limited not by the description but only by the following claims and equivalents thereof.

What is claimed is:

1. A shield for a paint roller of the type having a roller support member with a roller on one end and a handle on the other end, said shield including:

a bottom, sidewalls, a backwall, and a shield handle extending rearward of said back wall, all together in a dust pan configuration;

said shield handle including a hollow cylinder forming a tunnel therealong;

said shield handle including a lengthwise hinge along one side of said handle on which to open and close said handle, and a clasp on the opposite side of said handle to secure said handle in a closed condition;

said shield handle adapted to open and close, and effective to secure and immobilize said roller handle therewithin, and to permit axial adjustment of said roller handle relative to said shield handle.

2. A combination paint roller and shield; said paint roller including a roller support member with a roller on one end and a handle on the other end, said shield including the following improvement:

a bottom, sidewalls, a backwall, and a shield handle extending rearward of said back wall, all together in a dust pan configuration;

said shield handle including a hollow cylinder forming a tunnel therealong;

said shield handle including a lengthwise hinge along one side of said handle on which to open and close said handle, and a clasp on the opposite side of said handle to secure said handle in a closed condition;

said shield handle adapted to open and close, and effective to secure and immobilize said roller handle therewithin, and to permit axial adjustment of said roller handle relative to said shield handle.

* * * * *